US011663966B2

(12) United States Patent
In

(10) Patent No.: US 11,663,966 B2
(45) Date of Patent: May 30, 2023

(54) DEGRADATION COMPENSATION DEVICE AND DISPLAY DEVICE INCLUDING THE SAME

(71) Applicant: SAMSUNG DISPLAY CO., LTD., Yongin-si (KR)

(72) Inventor: Hai Jung In, Yongin-si (KR)

(73) Assignee: SAMSUNG DISPLAY CO., LTD., Gyeonggi-Do (KR)

( * ) Notice: Subject to any disclaimer, the term of this patent is extended or adjusted under 35 U.S.C. 154(b) by 9 days.

(21) Appl. No.: 16/793,489

(22) Filed: Feb. 18, 2020

(65) Prior Publication Data

US 2020/0265779 A1 Aug. 20, 2020

(30) Foreign Application Priority Data

Feb. 20, 2019 (KR) ..... 10-2019-0019840

(51) Int. Cl.
*G09G 3/3225* (2016.01)

(52) U.S. Cl.
CPC ..... *G09G 3/3225* (2013.01); *G09G 2310/027* (2013.01); *G09G 2320/0233* (2013.01); *G09G 2320/041* (2013.01); *G09G 2320/0686* (2013.01); *G09G 2360/145* (2013.01)

(58) Field of Classification Search
CPC ..... G09G 3/3225; G09G 2310/027; G09G 2320/0233; G09G 2320/041; G09G 2320/0686; G09G 2360/145
USPC ..... 345/207
See application file for complete search history.

(56) References Cited

U.S. PATENT DOCUMENTS 9,997,104 B2 6/2018 Zhang et al.
10,163,389 B2 12/2018 An et al.
10,262,582 B2 4/2019 Han
(Continued)

FOREIGN PATENT DOCUMENTS

KR 1020170003217 A 1/2017
KR 1020170088452 A 8/2017
KR 1020180059604 A 6/2018

OTHER PUBLICATIONS

Extended European Search Report for Application No. 20157867.1 dated May 29, 2020.

*Primary Examiner* — Amare Mengistu
*Assistant Examiner* — Gloryvid Figueroa-Gibson
(74) *Attorney, Agent, or Firm* — Cantor Colburn LLP

(57) ABSTRACT

A display device includes a display unit, a degradation compensator and a data driver. The display unit includes first and second pixels disposed in first and second regions, respectively. The degradation compensator generates a first compensated grayscale value by compensating a first grayscale value for the first pixel based on a first degradation curve and generates a second compensated grayscale value by compensating a second grayscale value for the second pixel based on a second degradation curve, where the first and second degradation curves define luminance reduction rates according to accumulated usage time of the first and second pixels, respectively. A data driver generates first and second data signals based on the first and second compensated grayscale values, respectively, and supplies the first and second data signals to the first and second pixels, respectively. A transmittance of the second region is greater than a transmittance of the first region.

17 Claims, 13 Drawing Sheets

(56) References Cited

U.S. PATENT DOCUMENTS

| | | | | |
|---|---|---|---|---|
| 2009/0051627 | A1* | 2/2009 | Ihata | G09G 3/3208 345/76 |
| 2011/0069051 | A1* | 3/2011 | Nakamura | G09G 3/3233 345/207 |
| 2012/0212516 | A1* | 8/2012 | Ahn | G09G 3/3233 345/690 |
| 2016/0140905 | A1* | 5/2016 | Yoo | G09G 3/3233 345/82 |
| 2017/0162103 | A1* | 6/2017 | An | G09G 3/3208 |
| 2017/0213493 | A1* | 7/2017 | Han | G09G 3/3208 |
| 2018/0129798 | A1 | 5/2018 | He et al. | |
| 2018/0151119 | A1 | 5/2018 | Lee et al. | |
| 2018/0173343 | A1 | 6/2018 | Pi et al. | |
| 2018/0190710 | A1 | 7/2018 | Ryu et al. | |
| 2018/0308422 | A1 | 10/2018 | Hwang et al. | |
| 2021/0065625 | A1* | 3/2021 | Wang | G09G 3/3266 |

* cited by examiner

DEGRADATION COMPENSATION DEVICE AND DISPLAY DEVICE INCLUDING THE SAME

This application claims priority to Korean Patent Application No. 10-2019-0019840, filed on Feb. 20, 2019, and all the benefits accruing therefrom under 35 U.S.C. § 119, the content of which in its entirety is herein incorporated by reference.

BACKGROUND

1. Field

Embodiments of the invention relate to a degradation compensation device and a display device including the degradation compensation device.

2. Description of the Related Art

An organic light emitting diode display includes an organic light emitting diode for controlling a luminance by a current or a voltage and a thin film transistor driving the organic light emitting diode.

In such an organic light emitting diode display, a pixel may be degraded by a degradation of the organic light emitting diode and the thin film transistor. Even if a same voltage is applied to the pixel, the current flowing through the pixel decreases due to the degradation of the organic light emitting diode and the thin film transistor, thereby deteriorating the luminance of the pixel.

The display device may update the accumulated usage time of the pixel and compensates for the degradation of the pixel by compensating for the grayscale value corresponding to the pixel based on the accumulated usage time.

SUMMARY

Recently, a display device includes an optical sensor to sense a light penetrated through a display panel, and the display panel may have a partially different resolution to improve the sensitivity of the optical sensor.

In such a display device, a relatively high current may be provided to a pixel in a relatively low resolution region to compensate for the difference in the luminance due to the difference in the resolution. However, the degradation of the pixel in a relatively low resolution region may be accelerated, and the degradation compensation may not be properly performed.

An exemplary embodiment of the invention provides a degradation compensation device and a display device including the degradation compensation device that effectively compensates for a degradation of pixels in the display panel having partially different resolutions.

An exemplary embodiment of a display device according to the invention includes a display unit including a first pixel disposed in a first region and a second pixel disposed in a second region different from the first region; a degradation compensator which generates a first compensated grayscale value by compensating for a first grayscale value for the first pixel based on a first degradation curve, and generates a second compensated grayscale value by compensating for a second grayscale value for the second pixel based on a second degradation curve, wherein the first degradation curve defines a luminance reduction rate according to a first accumulated usage time of the first pixel, and the second degradation curve defines a luminance reduction rate according to a second accumulated usage time of the second pixel; and a data driver which generates a first data signal based on the first compensated grayscale value to supply the first data signal to the first pixel, and generates a second data signal based on the second compensated grayscale value to supply the second data signal to the second pixel, where a light transmittance of the second region is greater than a light transmittance of the first region.

According to an exemplary embodiment of the invention, the display unit may include a transmissive region between the second pixel and an adjacent pixel in the second region, the transmissive region may transmit at least a portion of incident light, the adjacent pixel may be disposed adjacent to the second pixel in the second region, and a resolution of the second region may be lower than a resolution of the first region.

According to an exemplary embodiment of the invention, the display device may further include an optical sensor disposed to overlap the second region of the display unit, where the optical sensor senses light transmitted to the second region.

According to an exemplary embodiment of the invention, a voltage level of the first data signal may be different from a voltage level of the second data signal when the first grayscale value and the second grayscale value are the same, and a difference between a voltage level of the first data signal and a voltage level of the second data signal increases as the first accumulated usage time or the second accumulated usage time increases when the first accumulated usage time and the second accumulated usage time are equal to each other.

According to an exemplary embodiment of the invention, each of the first pixel and the second pixel may include a transistor and a light emitting element connected to the transistor to receive a driving current through the transistor, and a second driving current flowing in the second pixel corresponding to the second data signal may be greater than a first driving current flowing in the first pixel corresponding to the first data signal when the first grayscale value and the second grayscale value are equal to each other.

According to an exemplary embodiment of the invention, the degradation compensator may compensate for a first grayscale value using a first lookup table and compensate for a second grayscale value using a second lookup table, the first lookup table may include a first grayscale compensation value corresponding to the first accumulated usage time based on the first degradation curve, and the second lookup table may include a second grayscale compensation value corresponding to the second accumulated usage time based on the second degradation curve.

According to an exemplary embodiment of the invention, a second degradation acceleration factor, which refers to a slope of a tangent with respect to the second degradation curve, may be greater than a first degradation acceleration factor, which refers to a slope of a tangent with respect to the first degradation curve.

According to an exemplary embodiment of the invention, the degradation compensator may include an accumulator which calculates the first accumulated usage time by accumulating the first compensated grayscale value and calculates the second accumulated usage time by accumulating the second compensated grayscale value; a memory which stores the first and second accumulated usage times and the first and second lookup tables; and a compensator which obtains the first grayscale compensation value based on the first accumulated usage time and the first lookup table to compensate for the first grayscale value and obtains the second grayscale compensation value based on the second accumulated usage time and the second lookup table to compensate for the second grayscale value.

According to an exemplary embodiment of the invention, when the first grayscale value and the second grayscale value are equal to each other during a reference time, a change in the second accumulated usage time may be greater than a change in the first accumulated usage time during the reference time.

According to an exemplary embodiment of the invention, the first grayscale value and the second grayscale value may be included in an image data, and the compensator may include a selector which selects the first lookup table based on position information of the first grayscale value in the image data and selects the second lookup table based on position information of the second grayscale value in the image data; and a calculator which calculates the first compensated grayscale value by adding the first grayscale compensation value obtained from the first lookup table to the first grayscale value and calculates the second compensated grayscale value by adding the second grayscale compensation value obtained from the second lookup table to the second grayscale value.

According to an exemplary embodiment of the invention, the second pixel may include a plurality of sub-pixels which emit light of different colors from each other, and the second lookup table includes sub-lookup tables corresponding to degradation curves of the plurality of sub-pixels, respectively.

According to an exemplary embodiment of the invention, the second lookup table may be set for a representative grayscale value, the representative grayscale value is a grayscale value within a grayscale range of the second grayscale value, the degradation compensator may compensate for the second grayscale value based on a grayscale factor, and the grayscale factor may be a degradation compensation ratio set based on the representative grayscale value.

According to an exemplary embodiment of the invention, the degradation compensator may further include a first factor lookup table including the grayscale factor set for each grayscale value.

According to an exemplary embodiment of the invention, the second lookup table may include a plurality of sub-lookup tables for a plurality of representative grayscale values, and the degradation compensator may select first and second sub-lookup tables from the sub-lookup tables corresponding to a first and second representative grayscale values adjacent to the second grayscale value of the representative grayscale values from the sub-lookup tables, obtain a grayscale compensation value from each of the first and second sub-lookup tables based on the second accumulated usage time, and calculate the second grayscale compensation value by interpolating a grayscale compensation value obtained from the first sub-lookup table and a grayscale compensation value obtained from the second sub-lookup table.

According to an exemplary embodiment of the invention, the degradation compensator may determine a temperature factor based on temperature information received from an outside and compensate for the second grayscale value based on the temperature factor.

According to an exemplary embodiment of the invention, the degradation compensator may further include a second factor lookup table including the temperature factor set by temperature.

According to an exemplary embodiment of the invention, the second lookup table may include a plurality of sub-lookup tables set by temperature, and the degradation compensator may select one of the sub-lookup tables based on temperature information received from an outside and obtain the second grayscale compensation value from the selected one of the sub-lookup tables based on the second accumulated usage time.

According to an exemplary embodiment of the invention, the first pixel and the second pixel may have a same pixel structure as each other, and the second region may have a same luminance as a luminance of the first region.

An exemplary embodiment of a degradation compensation device according to the invention includes an accumulator which calculates a first accumulated grayscale value by accumulating a first grayscale value of an image data for a pixel in a first region and calculates a second accumulated grayscale value by accumulating a second grayscale values of the image data for a pixel in a second region; a storage unit which stores a first lookup table including a first grayscale compensation value corresponding to the first accumulated grayscale value and a second lookup table including a second grayscale compensation value corresponding to the second accumulated grayscale value; and a compensator that compensates for the first grayscale value based on the first lookup table and compensates for the second grayscale value based on the second lookup table, where the first grayscale value and the second grayscale value correspond to a same color as each other.

According to an exemplary embodiment of the invention, when the first grayscale value and the second grayscale value are equal to each other during a reference time, a change in the second accumulated grayscale value may be greater than a change in the first accumulated grayscale value during the reference time.

In exemplary embodiment, a degradation compensation device and a display device including the degradation compensation device may compensate for a degradation of a pixel more accurately by performing degradation compensation for pixels disposed in regions having relatively different resolutions by using independent degradation curves of which degradation acceleration factors are different from each other.

BRIEF DESCRIPTION OF THE DRAWINGS

The above and other features of exemplary embodiments of the invention will become readily apparent by reference to the following detailed description when considered in conjunction with the accompanying drawings, in which.

DETAILED DESCRIPTION

Figure 1:
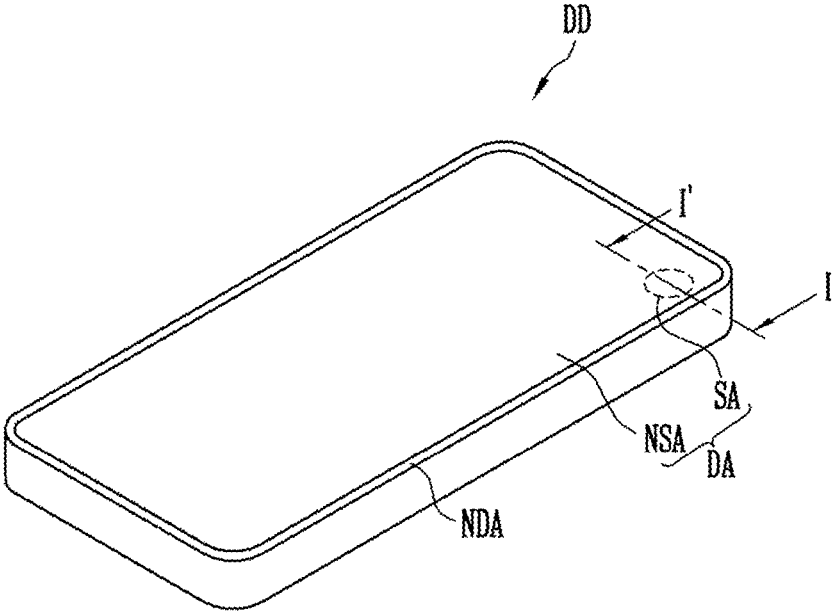
FIG. 1 is a perspective view of a display device according to an exemplary embodiment of the invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, "a first element," "component," "region," "layer" or "section" discussed below could be termed a second element, component, region, layer or section without departing from the teachings herein.

The terminology used herein is for the purpose of describing particular embodiments only and is not intended to be limiting. As used herein, the singular forms "a," "an," and "the" are intended to include the plural forms, including "at least one," unless the content clearly indicates otherwise. "Or" means "and/or." As used herein, the term "and/or" includes any and all combinations of one or more of the associated listed items. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

"About" or "approximately" as used herein is inclusive of the stated value and means within an acceptable range of deviation for the particular value as determined by one of ordinary skill in the art, considering the measurement in question and the error associated with measurement of the particular quantity (i.e., the limitations of the measurement system). For example, "about" can mean within one or more standard deviations, or within ±30%, 20%, 10%, 5% of the stated value.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized to embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments of the invention will be described in detail with reference to the accompanying drawings.

FIG. 1 is a perspective view of a display device according to an exemplary embodiment of the invention.

Referring to FIG. 1, an exemplary embodiment of a display device DD includes a display region DA and a non-display region NDA. The display region DA and the non-display region NDA may be defined on a surface (or a display surface) of the display device DD. The display region DA may be a region where an image is displayed, and the non-display region NDA may be disposed along a boundary of the display region DA, but not being limited thereto. In one exemplary embodiment, for example, the non-display region NDA may be disposed at one side of the display region DA.

In an exemplary embodiment, the display region DA may include a sensing region SA and a non-sensing region NSA. The display device DD may not only display an image but also detect light incident from outside (e.g., a front) through the sensing region SA. The non-sensing region NSA may surround the sensing region SA, but not being limited thereto. The sensing region SA has a circular planar shape and is disposed close to one side in the display region DA in FIG. 1, but not being limited thereto. The shape, size and disposition of the sensing region SA may be variously modified according to a sensor described later.

Figure 2:
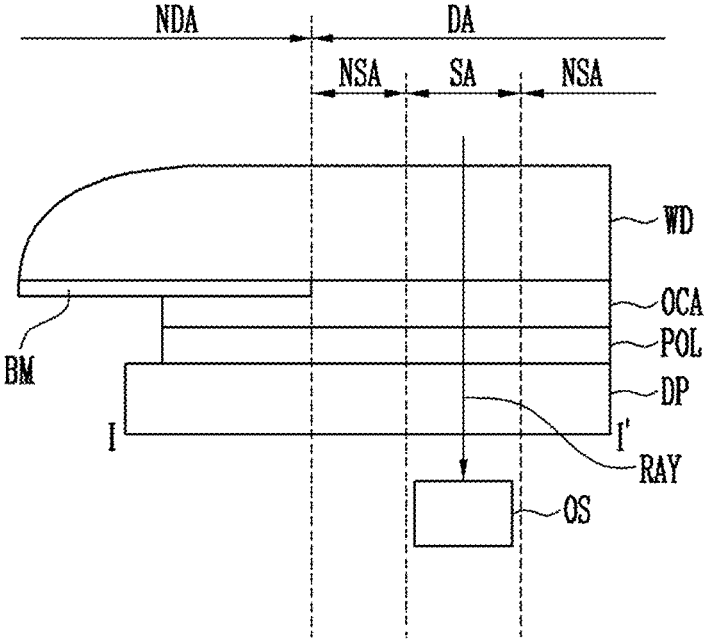
FIG. 2 is a cross-sectional view taken along line I-I' of FIG. 1 illustrating an exemplary embodiment of a display device.

FIG. 2 is a cross-sectional view taken along a line I-I' of FIG. 1 for illustrating an exemplary embodiment of a display device.

Hereinafter, a direction perpendicular to a display surface, on which an image is displayed, is defined as an upper direction, and a direction opposite to the upper direction is defined as a lower direction in the display device DD. An exemplary embodiment of the display device DD will hereinafter be described in greater detail.

Referring to FIGS. 1 and 2, an exemplary embodiment of the display device DD may include a display panel DP, a polarizer POL, a black matrix BM, a window WD and an optical sensor OS.

The display panel DP may display an image based on image data supplied from the outside. In one exemplary embodiment, for example, the display panel DP may be an organic light emitting diode display panel including an organic light emitting diode, but not being limited thereto.

The polarizer POL may be disposed on the display panel DP and may restrain light incident thereto from an outside from being reflected to the outside by polarizing light incident from the outside. In such an embodiment, the polarizer POL may perform antireflection function and effectively prevent the visibility of the display panel DP from being degraded by the light incident from the outside.

The window WD may be disposed above the polarizer POL and may protect a structure therebelow (e.g., the display panel DP) from external impacts. The window WD may be attached to the polarizer POL by an optical clear adhesive OCA.

The black matrix BM may be disposed between the window WD and the display panel DP in the non-display region NDA. The black matrix BM may absorb light incident from the outside and prevent a structure therebelow (e.g., display panel DP) disposed in the non-display region NDA from being viewed from the outside.

The optical sensor OS may be disposed under the display panel DP in the sensing region SA. The optical sensor OS may sense the light RAY transmitted through the sensing region SA of the display panel DP. In one exemplary embodiment, for example, the optical sensor OS may be implemented as an infrared sensor and sense infrared light (i.e., light in the infrared wavelength band) transmitted through the sensing region SA of the display panel DP. The light sensed by the optical sensor OS may be used to authenticate the user's biometric information (e.g., iris, fingerprint, etc.).

In an exemplary embodiment of the invention, a transmittance (i.e., light transmittance or transmittance of light) in the sensing region SA of the display panel DP may be greater than a transmittance in the non-sensing region NSA. In one exemplary embodiment, for example, the sensing region SA of the display panel DP may include a transmissive region (or a transparent region) for transmitting light and thus a resolution (or pixel density) in the sensing region of the display panel DP may be lower than a resolution in the non-sensing region NSA. The resolution of the sensing region SA will be described later in greater detail with reference to FIG. 4.

In such an embodiment, where the resolution of the sensing region SA is lower than the resolution of the non-sensing region NSA, a current flowing through a pixel in the sensing region SA may be greater than a current flowing through a pixel in the non-sensing region NSA to display an image with a uniform luminance, such that the pixel in the sensing region SA may be degraded faster than the pixel in the non-sensing region NSA, and a degradation characteristic of the pixel in the sensing region SA may be different from a degradation characteristic of the pixel in the non-sensing region NSA.

Accordingly, an exemplary embodiment of the display device DD (or display panel DP) according to the invention may respectively perform a degradation compensation for pixels in the sensing region SA and pixels the non-sensing region NSA based on different degradation curves (or degradation compensation curves).

Figure 3:
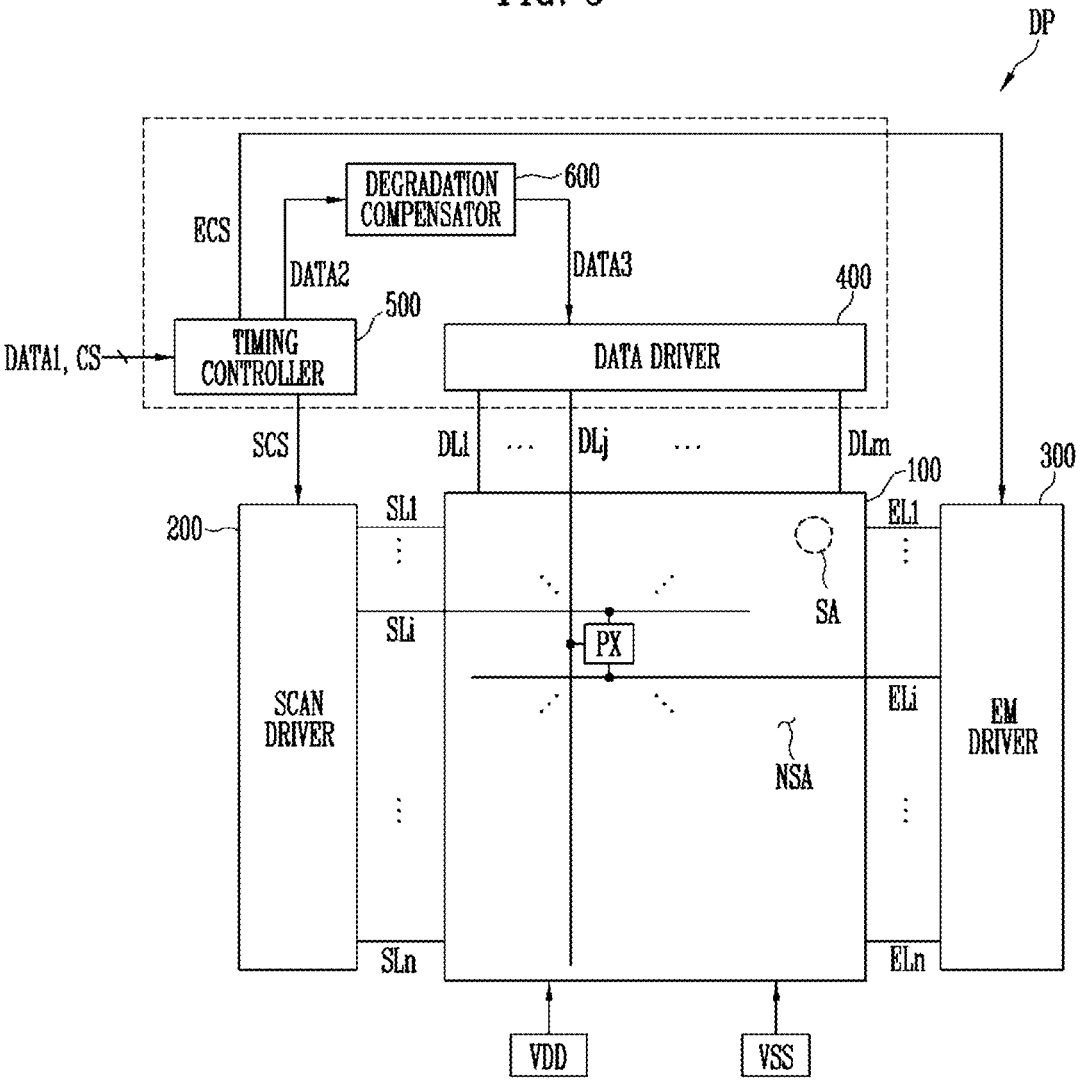
FIG. 3 is a block diagram for illustrating an exemplary embodiment of a display panel included in a display device of FIG. 2.

FIG. 3 is a block diagram for illustrating an exemplary embodiment of a display panel included in a display device of FIG. 2.

Referring to FIG. 3, the display panel DP may include a display unit 100, a scan driver 200, a light emission driver 300, a data driver 400, a timing controller 500, and a degradation compensator 600.

The display unit 100 may include scan lines SL1 to SLn (here, n is a positive integer greater than 2), light emission lines EL1 to ELn, data lines DL1 to DLm (here, m is a positive integer greater than 2), and a pixel PX. In one exemplary embodiment, for example, the pixel PX may be disposed in a region (e.g., pixel region) partitioned by the scan lines SL1 to SLn, the light emission lines EL1 to ELn, and the data lines DL1 to DLm.

The pixel PX may be connected to a corresponding one of the scan lines SL1 to SLn, a corresponding one of the light emission lines EL1 to ELn, and a corresponding one of the data lines DL1 to DLm. In one exemplary embodiment, for example, the pixel PX may be connected to an i-th scan line SLi, an i-th light emission line ELi, and a j-th data line DLj (here, i and j are positive integers).

The pixel PX may emit light corresponding to a data signal supplied through the j-th data line DLj in response to a scan signal supplied through the i-th scan line SLi and a light emission signal supplied through the i-th light emission line ELi. The configuration and operation of the pixel PX, will be described later in greater detail with reference to FIG. 7.

In an exemplary embodiment, as described above with reference to FIGS. 1 and 2, the resolution in the sensing region SA may be lower than the resolution in the non-sensing region NSA.

The scan driver 200 may generate a scan signal based on a scan control signal SCS and sequentially supply the scan signal to the scan lines SL1 to SLn. Here, the scan control signal SCS may include a start signal (or a scan start signal), clock signals (or scan clock signals) or the like, and may be supplied from the timing controller 500. In one exemplary embodiment, for example, the scan driver 200 may include a shift register that sequentially generates and outputs a scan signal in response to the start signal based on the clock signals. The scan driver 200 may be disposed or formed in the display unit 100 or may be implemented as an integrated circuit ("IC") and connected to the display unit 100 in a form of a tape carrier package.

The light emission driver 300 may generate a light emission signal based on a light emission control signal ECS and supply the light emission signal to the light emission lines EL1 to ELn. In an exemplary embodiment, the light emission control signal ECS may include a light emission start signal, a light emission clock signals or the like. In one exemplary embodiment, for example, the light emission driver 300 may sequentially generate and output a light emission signal in response to the light emission start signal based on the light emission clock signals. The light emission driver 300 may be disposed or formed in the display unit 100 or may be implemented as an IC and connected to the display unit 100 in a form of a tape carrier package. In one exemplary embodiment, for example, the light emission driver 300 and the scan driver 200 may be implemented as a single IC.

The data driver 400 may generate data signals based on a compensated data DATA3 supplied from the degradation compensator 600 and supply the data signals to the display unit 100 or the pixel PX. The data driver 400 may be connected to the display unit 100 in a form of a tape carrier package. In one exemplary embodiment, for example, the data driver 400 and the scan driver 200 may be implemented as a single IC.

The timing controller 500 may receive input image data DATA1 and a control signal CS from outside or an external device (e.g., a graphic processor or a graphics processing unit), generate scan control signal SCS and light emission control signal ECS, and generate the image data DATA2 by converting the input image data DATA1. In one exemplary embodiment, for example, the timing controller 500 may convert input image data DATA1 in RGB format to image data DATA2 in RGBG format that conforms to a pixel array in display unit 100.

The degradation compensator 600 may calculate a degree of degradation of the pixel PX based on the image data DATA2 and generate the compensated data DATA3 (or degraded compensated data) to compensate for the image data DATA2 based on the degree of degradation of the pixel PX.

In one exemplary embodiment, for example, the degradation compensator 600 may calculate the degree of degradation (or accumulated usage time, stress) of the pixel PX by accumulating a grayscale value (i.e., the grayscale value corresponding to the pixel PX) included in the image data DATA2, and may calculate the compensated grayscale value by compensating the grayscale value based on a predetermined degradation curve and the degree of degradation of the pixel PX. Here, the degradation curve may represent luminance reduction rate according to the degree of degradation and the compensated grayscale value may be included in the compensated data DATA3.

In an exemplary embodiment of the invention, the degradation compensator 600 may compensate for a first grayscale value corresponding to the pixel PX in the non-sensing region NSA and a second grayscale value corresponding to the pixel PX in the sensing region SA by using degradation curves different from each other.

In one exemplary embodiment, for example, the degradation compensator 600 may compensate for the first grayscale value corresponding to the pixel PX in the non-sensing region NSA based on a first degradation curve (or using a degradation compensation equation corresponding to the first degradation curve or a lookup table), and may compensate for the second grayscale value corresponding to the pixel PX in the sensing region SA based on a second degradation curve (or using degradation compensation equation corresponding to the second degradation curve or a lookup table).

The configuration and operation of the degradation compensator 600 will be described later in greater detail with reference to FIG. 8.

In an exemplary embodiment, first and second power source voltages VDD and VSS may be supplied to the display unit 100. The power source voltages VDD and VSS are voltages used for the operation of the pixel PX. A voltage level of the first power source voltage VDD may be higher than a voltage level of the second power source voltage VSS. In an exemplary embodiment, although not shown in FIG. 1, an initialization voltage may be applied to the display unit 100, and the initialization voltage may be used to initialize a previous data signal stored in the pixel PX.

In an exemplary embodiment, the timing controller 500 and the degradation compensator 600 may be separated from each other as shown in FIG. 3. Alternatively, the timing controller 500 and the degradation compensator 600 may be implemented as a single IC since the timing controller 500 and the degradation compensator 600 are conceptually separated according to functions. Alternatively, the timing controller 500 may include a data driver 400 or the like.

Figure 4:
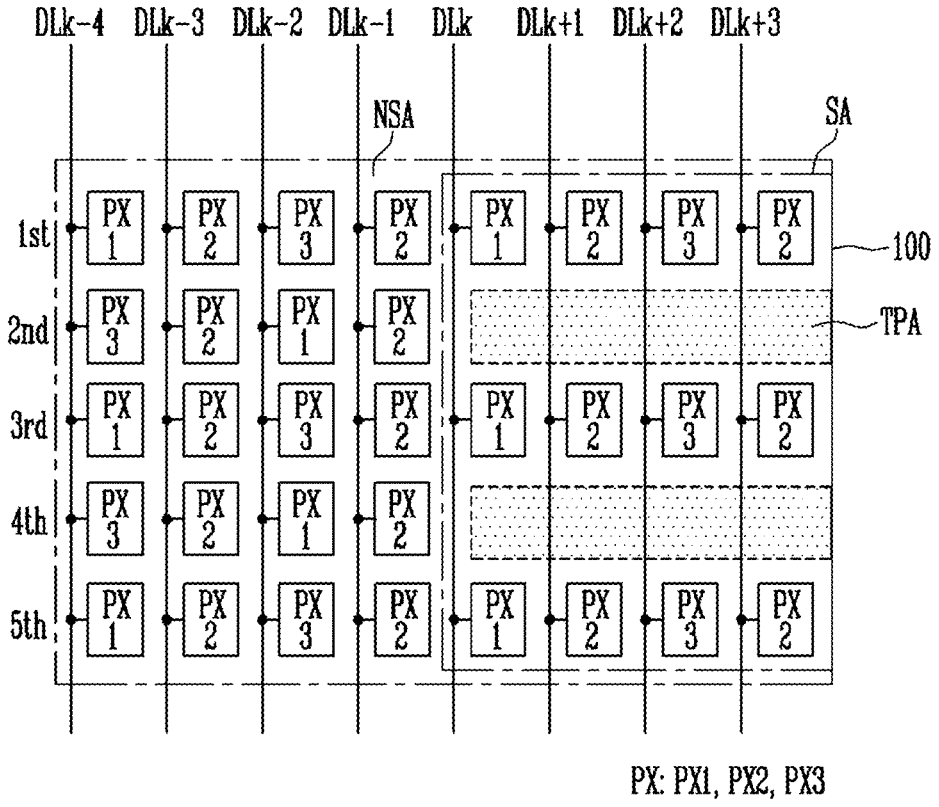
FIG. 4 is a drawing for illustrating an exemplary embodiment of pixels disposed in a sensing region of FIG. 3.

FIG. 4 is a drawing for illustrating an exemplary embodiment of pixels disposed in a sensing region of FIG. 3. FIG. 4 shows arrangements of pixels PX1, PX2, and PX3 (or sub-pixels) in the display unit 100 with reference to the sensing region SA shown in FIG. 3.

Referring to FIG. 4, the display unit 100 may include first to third pixels PX1, PX2, and PX3.

The first to third pixels PX1, PX2 and PX3 may be arranged in a matrix form in the display unit 100 and emit lights of different colors.

In one exemplary embodiment, for example, the first pixel PX1 may emit light of a first color (e.g., a red color), the second pixel PX2 may emit light of a second color (e.g., a green color), and the third pixel PX3 may emit light of a third color (e.g., a blue color).

In an exemplary embodiment, the first to third pixels PX1, PX2, and PX3 may be arranged in a form of a pentile. In such an embodiment, as shown in FIG. 4, the first pixel PX1, the second pixel PX2, the third pixel PX3, and the second pixel PX2 may be disposed sequentially and repeatedly in one direction. But, the embodiments are not limited thereto. In one exemplary embodiment, for example, the first to third pixels PX1, PX2, and PX3 may be disposed in the form of an RGB stripe.

In an exemplary embodiment, the sensing region SA of the display unit 100 may include a transmissive region TPA (or a transparent region). Here, the transmissive region TPA is a region for transmitting light and may include a transparent material instead of the pixels PX1, PX2, and PX3. In one exemplary embodiment, for example, the transparent material may be a resin such as polyethylene terephthalate ("PET"), polyacrylate, polyimide ("PI"), polycarbonate ("PC") or the like.

In one exemplary embodiment, for example, the pixels PX1, PX2, and PX3 may be disposed in each of a first to fifth rows of the non-sensing region NSA, the pixels PX1, PX2, and PX3 may be disposed in the first, third, and fifth rows (e.g., odd numbered rows) of the sensing region SA, and the transmissive region TPA may be disposed instead of the pixels PX1, PX2 and PX3 in the second and fourth rows (e.g., even numbered rows) of the sensing region SA, as shown in FIG. 4. The position of the transmissive region TPA shown in FIG. 4 is merely exemplary, and not being limited thereto. In one exemplary embodiment, for example, the transmissive region TPA may correspond to the k-th and (k+2)-th data lines DLk and DLk+2 (here, k is an integer greater than 4) or may be arranged in a lattice form in the sensing region SA. In such an embodiment, the arrangement of the transmissive region TPA may be modified in various ways.

In an exemplary embodiment, the transmissive region TPA may include a color filter material that transmits or blocks only light of a specific wavelength. In one exemplary embodiment, for example, the transmissive region TPA may include a filter material that blocks visible light (i.e., light in visible wavelength band) and transmits only infrared light (i.e., light in an infrared wavelength band).

Since the sensing region SA includes the transmissive region TPA, the transmittance of the sensing region SA may be higher than the transmittance of the non-sensing region NSA and the resolution of the sensing region SA may be lower than the resolution of the non-sensing region NSA.

If the pixels PX1, PX2, and PX3 emit light with a same luminance as each other, the luminance of the sensing region SA may be lower than the luminance of the non-sensing region NSA depending on the resolution. In this case, the sensing region SA that has a relatively low-luminance may be viewed by the user.

In an exemplary embodiment, the data driver 400, as described with reference to FIG. 3, may apply a relatively high or low data voltage to the pixels PX1, PX2, and PX3 of the sensing region SA to improve luminance uniformity. Accordingly, a driving current (or a second driving current) greater than a driving current (or a first driving current) flowing in the pixels PX1, PX2, and PX3 of the non-sensing region NSA may flow in the pixels PX1, PX2, and PX3 of the sensing region SA, and the luminance of the sensing region SA may be the same as the luminance of the non-sensing region NSA.

Figure 5:
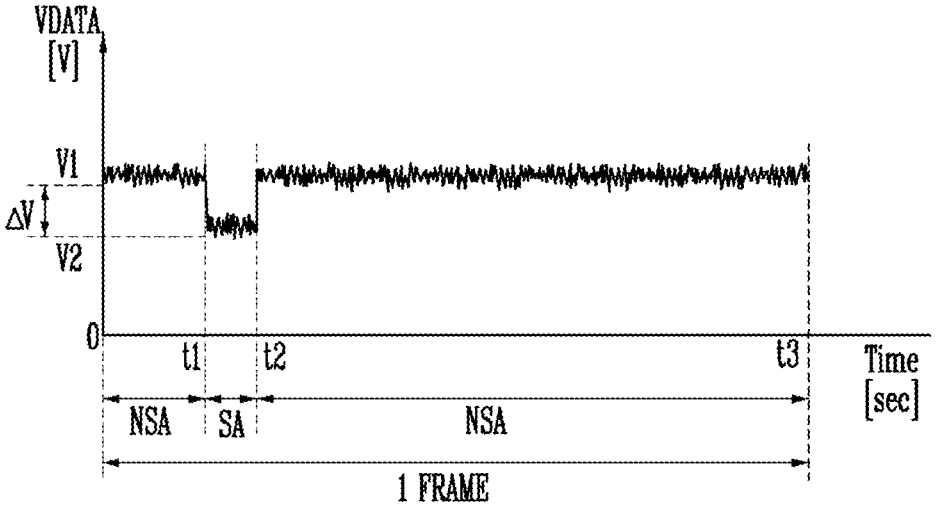
FIG. 5 is a waveform diagram for illustrating an exemplary embodiment of a data signal applied to pixels of FIG. 4.

FIG. 5 is a waveform diagram for illustrating an exemplary embodiment of a data signal applied to pixels of FIG. 4. FIG. 5 shows an exemplarily embodiment of the data signal VDATA applied to one data line (e.g., the k-th data line DLk) connected to the pixels PX1, PX2, and PX3 in the sensing region SA shown in FIG. 4 during one frame 1 FRAME. It is assumed that the pixels PX1, PX2, and PX3 include P-type transistors and the grayscale values corresponding to the pixels PX1, PX2, and PX3 are the same each other.

Referring to FIGS. 3 to 5, the data signal VDATA (or the first data signal) may have a first voltage level V1 in a period between a reference time when the data signal VDATA is applied (or written) to the non-sensing region NSA and a first time point t1 and in a period between a second time point t2 and a third time point t3. The data signal VDATA (or second data signal) may have a second voltage level V2 in a period between the first time point t1 and the second time point t2 when the data signal VDATA is applied to the sensing region SA. The second voltage level V2 may be different from the first voltage level V1, and may be lower than the first voltage level V1 by a certain level (A V), for example. Accordingly, each of the pixels PX1, PX2, and PX3 in the sensing region SA may emit light at a luminance higher than each of the pixels PX1, PX2, and PX3 in the non-sensing region NSA.

In such an embodiment, as the relatively high driving current is continuously applied, the degradation of the pixels PX1, PX2, and PX3 (see FIG. 4) in the sensing region SA may be accelerated, and the luminance in the sensing region SA may be reduced faster than the luminance in the non-sensing region NSA with time.

Figure 6:
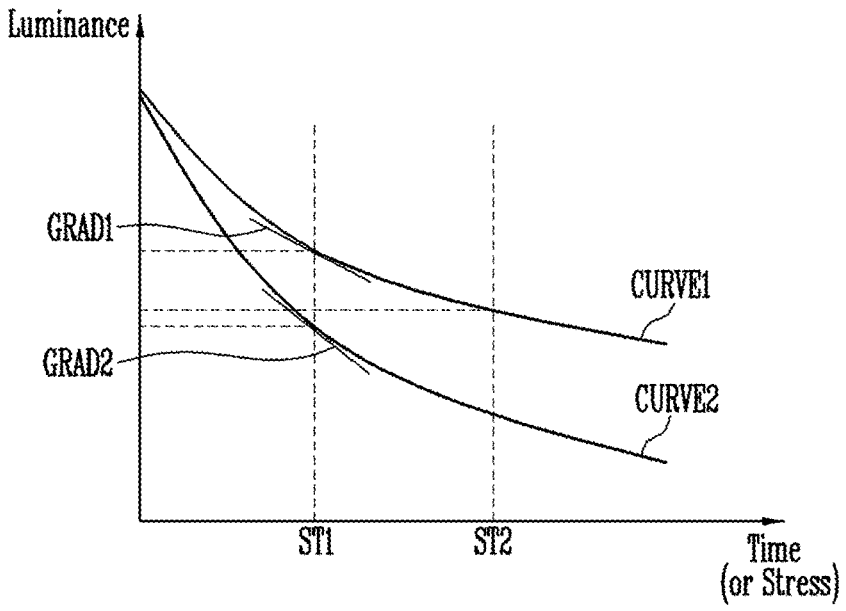
FIG. 6 is a graph illustrating a degradation characteristic of pixels of FIG. 4.

FIG. 6 is a graph illustrating a degradation characteristic of pixels of FIG. 4. FIG. 6 shows a first degradation curve CURVE1 for the pixel PX in a non-sensing region NSA and a second degradation curve CURVE2 for the pixel PX in a sensing region SA shown in FIG. 4. Each of the first and second degradation curves CURVE1 and CURVE2 represents a luminance change (or luminance reduction rate) according to the accumulated usage time (or stress) of the pixel PX.

Referring to FIG. 6, at the first accumulated usage time ST1, the luminance of the pixel PX in the sensing region SA may be lower than the luminance of the pixel PX in the non-sensing region NSA.

In an exemplary embodiment, at a first accumulated usage time ST1, a second slope GRAD2 of a second tangent of the second degradation curve CURVE2 may be greater than a first slope GRAD1 of a first tangent of the first degradation curve CURVE1. The second slope GRAD2 may be defined as a second degradation acceleration factor representing the degree of the degradation acceleration of the pixel PX in the sensing region SA at corresponding time. Similarly, the first slope GRAD1 may be defined as a first degradation acceleration factor representing the degree of degradation acceleration of the pixel PX in the non-sensing region NSA at corresponding time.

That is, even if the luminance of the entire display device DD (or the display unit 100) becomes uniform by providing a relatively high driving current to the pixels PX1, PX2, and PX3 of the sensing region SA, image sticking may occur in the sensing region SA as the pixels PX1, PX2, and PX3 of the sensing region SA are degraded faster.

As shown in FIG. 6, the luminance of the pixel PX in the non-sensing region NSA at a second accumulated usage time ST2 may be higher than the luminance of the pixel PX in the sensing region SA at the first accumulated usage time ST1. Here, the second accumulated usage time ST2 may be about twice the first accumulated usage time ST1.

That is, as the degradation of the pixel PX in the sensing region SA is accelerated, the degradation characteristic of the pixel PX in the sensing region SA may be worse than the degradation characteristic of the pixel PX in the non-sensing region NSA. Therefore, the degradation characteristic of the pixel PX in the sensing region SA and the degradation characteristic of the pixel PX in the non-sensing region NSA may not be effectively defined by a single degradation curve (e.g., the first degradation curve CURVE1).

Accordingly, an exemplary embodiment of a display device DD (or display panel DP) according to the invention may perform degradation compensation by storing the first and second degradation curves CURVE1 and CURVE2 (or lookup tables for corresponding degradation compensation), respectively, applying the first degradation curve CURVE1 to the pixel PX in the non-sensing region NSA, and applying the second degradation curve CURVE2 to the pixel PX in the sensing region SA.

Figure 7:
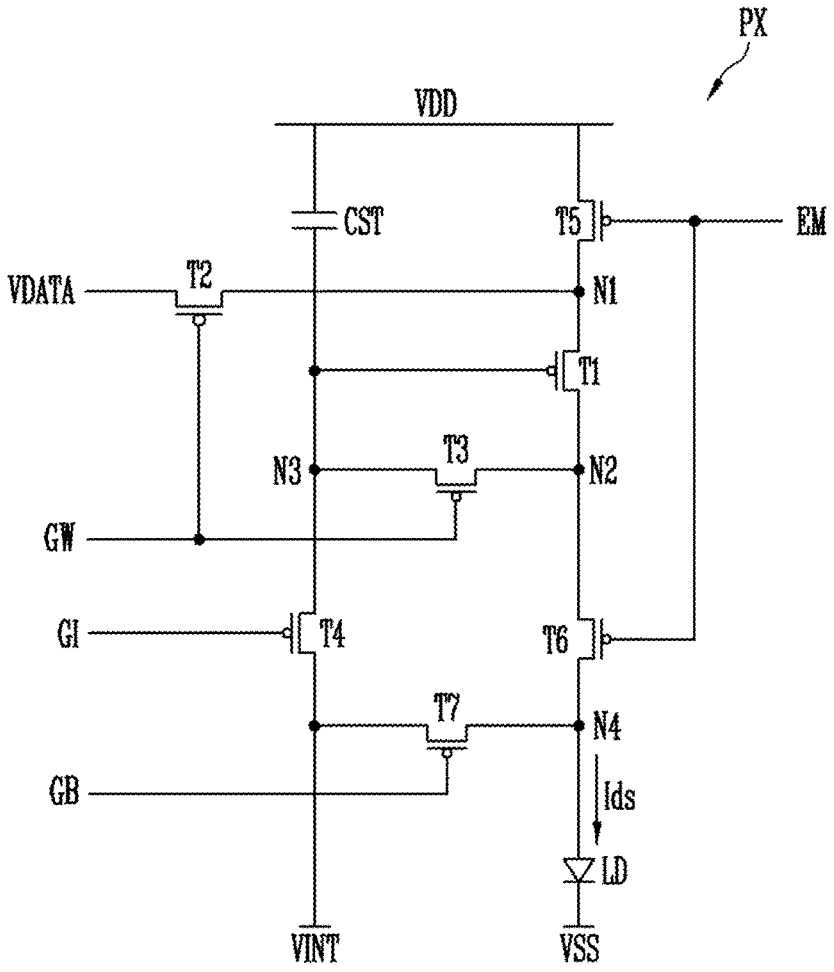
FIG. 7 is a circuit diagram for illustrating an exemplary embodiment of a pixel of FIG. 4.

FIG. 7 is a circuit diagram for illustrating an exemplary embodiment of a pixel of FIG. 4. FIG. 7 shows a pixel circuit for one of the pixels PX1, PX2, and PX3 shown in FIG. 4. Since the pixels PX1, PX2, and PX3 shown in FIG. 4 are substantially the same as each other, the pixels PX1, PX2, and PX3 will be described with reference to the pixel PX.

Referring to FIG. 7, an exemplary embodiment of the pixel PX may include first to seventh transistors T1 to T7, a storage capacitor CST, and a light emitting diode LD.

The first to seventh transistors T1 to T7 may be a P-type transistor, e.g., a P-type metal-oxide-semiconductor ("PMOS") transistor, but not being limited thereto. In one exemplary embodiment, for example, at least one of the first to seventh transistors T1 to T7 may be implemented as an N-type transistor, e.g., N-type metal-oxide-semiconductor ("NMOS") transistor.

The first transistor T1 (or driving transistor) may include a first electrode that is electrically connected to a first node N1, a second electrode that is electrically connected to a second node N2, and a gate electrode that is electrically connected to a third node N3.

The second transistor T2 may include a first electrode connected to the data line (i.e., line transmitting a data signal VDATA), a second electrode connected to the first node N1, and a gate electrode connected to a first scan line (i.e., line transmitting a first scan signal GW). The second transistor T2 may be turned on in response to the first scan signal GW supplied through the first scan line and transmit the data signal VDATA supplied through the data line to the first node N1. In one exemplary embodiment, for example, the scan signal may be a pulse signal with a turn-on voltage level (or logic low level) that turns on the transistor.

The third transistor T3 may include a first electrode connected to the second node N2, a second electrode connected to the third node N3, and a gate electrode connected to the first scan line. The third transistor T3 may be turned on in response to the first scan signal GW and may transmit the data signal VDATA transmitted through the first transistor T1 from the first node N1 to the third node N3.

The storage capacitor CST may be connected between the first power line and the third node N3. Here, a first power source voltage VDD may be applied to the first power line. The storage capacitor CST may store the data signal VDATA transmitted to the third node N3.

The fourth transistor T4 may include a first electrode connected to the third node N3, a second electrode connected to the initialization voltage line, and a gate electrode connected to a second scan line (i.e., line transmitting a second scan signal GI). Here, the second scan line is a scan line adjacent to the first scan line, and the second scan signal GI may be a previous scan signal supplied before the first scan signal GW. The fourth transistor T4 may be turned on in response to the previous scan signal supplied through the second scan line or the second scan signal GI and may initialize the third node N3 by using an initialization voltage VINT supplied through the initialization voltage line. That is, a node voltage (or the data signal VDATA stored in the storage capacitor CST in a previous frame) of the third node N3 may be initialized to the initialization voltage VINT.

The fifth transistor T5 may include a first electrode connected to the first power line (or the first power line to which the first power source voltage VDD is applied), a second electrode connected to the first node N1, and a gate electrode connected to the light emission line (i.e., line transmitting the light emission signal EM). In such an embodiment, the sixth transistor T6 may include a first electrode connected to the second node N2, a second electrode connected to the fourth node N4, and a gate electrode connected to the light emission line.

The fifth transistor T5 and the sixth transistor T6 may be turned on in response to the light emission signal EM supplied through the light emission line, and a path of a driving current Ids may be formed between the first power line and the fourth node N4 (or second power line to which the second power source voltage VSS is applied).

The light emitting diode LD may include an anode connected to the fourth node N4 and a cathode connected to the second power line. In one exemplary embodiment, for example, the light emitting diode LD may be an organic light emitting diode or an inorganic light emitting diode. The light emitting diode LD may emit light with a luminance corresponding to the driving current Ids (or the current amount of the driving current Ids).

The seventh transistor T7 may include a first electrode connected to the fourth node N4, a second electrode connected to the initialization voltage line, and a gate electrode connected to a third scan line (i.e., line transmitting a third scan signal GB). The seventh transistor T7 may initialize the fourth node N4 (or parasitic capacitor of the light emitting diode LD) in response to the third scan signal GB. Here, the third scan signal GB may be the same as the second scan signal GI or may be supplied after the first scan signal GW.

In FIG. 7, the pixel PX is shown as including the first to seventh transistors T1 to T7, but this is merely exemplary and the pixel PX is not limited thereto. In one exemplary embodiment, for example, the pixel PX may include a driving transistor connected between the first power line and the second power line, and a switching transistor connected between the data line and the gate electrode of the driving transistor. That is, various known pixel circuits may be applied to the pixel PX.

Figure 8:
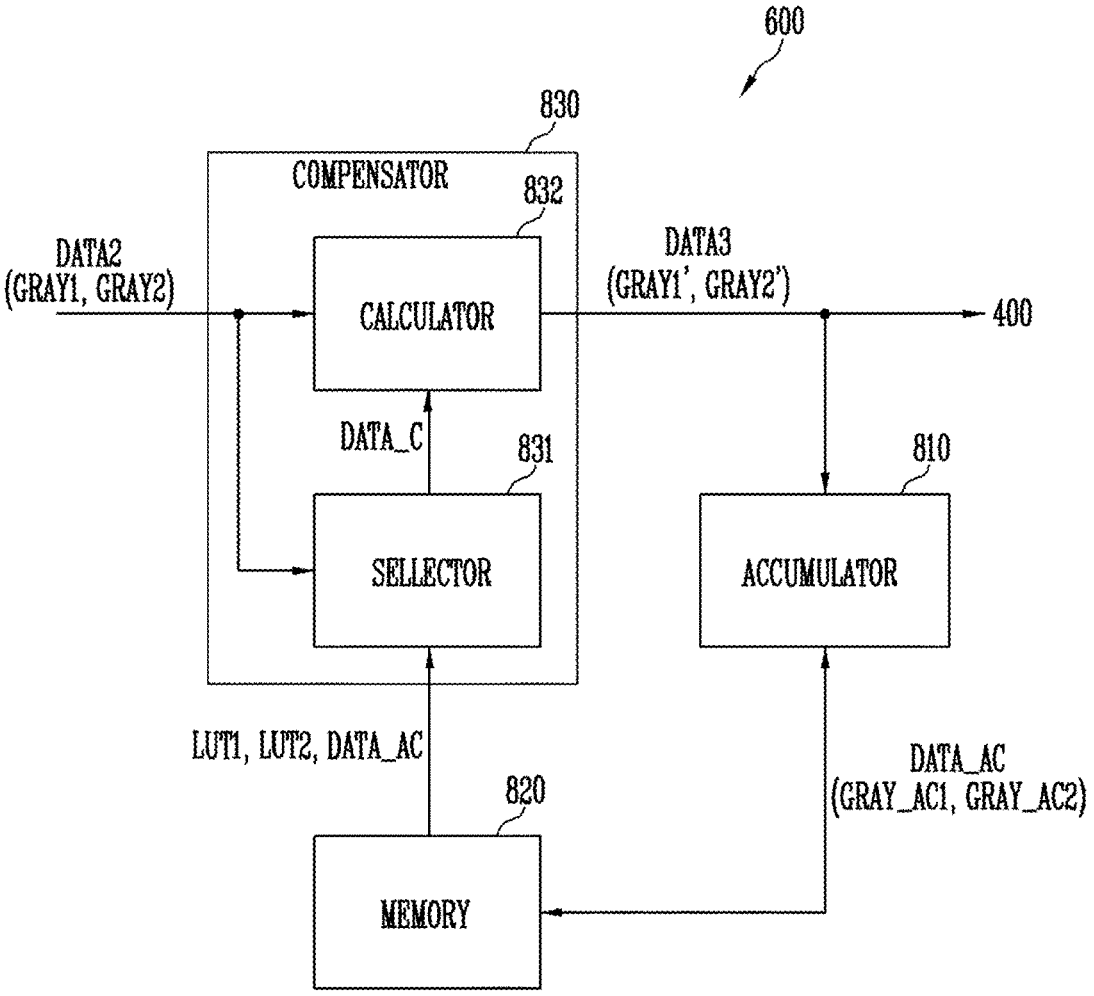
FIG. 8 is a block diagram for illustrating an exemplary embodiment of a degradation compensator included in a display panel of FIG. 3.

FIG. 8 is a block diagram for illustrating an exemplary embodiment of a degradation compensator included in a display panel of FIG. 3.

Referring to FIGS. 3 and 8, an exemplary embodiment of the degradation compensator 600 may include an accumulator 810, a storage unit 820, and a compensator 830.

The accumulator 810 (or stress calculator, usage time calculator) may calculate an accumulated usage time (or stress) of each pixel based on the compensated data DATA3.

In one exemplary embodiment, for example, the accumulator 810 may accumulate a first compensated grayscale value GRAY1' (or first conversion grayscale value) included in the compensated data DATA3 to calculate a first accumulated usage time of a pixel (hereinafter referred to as "first pixel") in the non-sensing region NSA, and may accumulate a second compensated grayscale value GRAY2' (or second conversion grayscale value) included in the compensated data DATA3 to calculate a second accumulated usage time of a pixel (hereinafter referred to as "second pixel") in the sensing region SA. Here, the first compensated grayscale value GRAY1' may be a grayscale value obtained by converting the first grayscale value GRAY1 corresponding to the first pixel by the degradation compensation, and the second compensated grayscale value GRAY2' may be a grayscale value obtained by converting the second grayscale value GRAY2 corresponding to the second pixel by the degradation compensation.

In one exemplary embodiment, for example, the accumulator 810 may accumulate the first compensated grayscale value GRAY1' for each frame or may average and downscale the first compensated grayscale value GRAY1' output for a specific period to calculate a first accumulated usage time for the first pixel. The accumulator 810 may add the first accumulated usage time to the first accumulated grayscale value GRAY_AC1 or update the first accumulated grayscale value GRAY_AC1 based on the first accumulated usage time. Here, the first accumulated grayscale value GRAY_AC1 may be included in the accumulated data DATA_AC (or usage time data), and the accumulated data DATA_AC may be stored and updated in the storage unit 820 described later.

In such an embodiment, the accumulator 810 may calculate the second accumulated usage time for the second pixel to update the second accumulated grayscale value GRAY_AC2, and the second accumulated grayscale value GRAY_AC2 may be included in the accumulated data DATA_AC and stored and updated in the storage unit 820.

The storage unit 820 (or memory device) may store the accumulated data DATA_AC, supply the accumulated data DATA_AC to the accumulator 810 in response to a request from the accumulator 810 (i.e., request for supplying the accumulated data DATA_AC), and update the accumulated data DATA_AC in real time or periodically.

In an exemplary embodiment, the storage unit 820 may store lookup tables LUT1 and LUT2 (or degradation compensation lookup tables). A first lookup table LUT1 may include the compensated grayscale values or the degradation compensation ratio of the first pixel for each accumulated usage time according to the degradation characteristic (e.g., the first degradation curve CURVE1 described with reference to FIG. 6) of the first pixel as shown in Table 1 below.

TABLE 1

| Division | 0 | T1 | T2 |
|---|---|---|---|
| . . . | . . . | . . . | . . . |
| GRAY1_L1 | GRAY1_L1 | GRAY1_L1' (GRAY1_L1 + GRAY1_D1) | GRAY1_L1" (GRAY1_L1 + GRAY1_D2) |
| . . . | . . . | . . . | . . . |

Table 1 shows an exemplary embodiment of the first lookup table LUT1.

According to an exemplary embodiment, the first lookup table LUT1 may correspond to the first input grayscale value GRAY1_L1 and may include compensated grayscale values GRAY1_L1' and GRAY1_L1" corresponding to each accumulated usage time T1 and T2.

According to an exemplary embodiment, the first lookup table LUT1 may include grayscale compensation values GRAY1_D1 and GRAY1_D2 (or compensation grayscale values) instead of compensated grayscale values GRAY1_L1' and GRAY1_L1". Here, the grayscale compensation values GRAY1_D1 and GRAY1_D2 may be a difference between the compensated grayscale values GRAY1_L1' and GRAY1_L1" according to the accumulated usage times T1 and T2 and the first input grayscale value GRAY1_L1.

In such an embodiment, a second lookup table LUT2 may include the compensated grayscale values or the degradation compensation ratio corresponding to the accumulated usage time of the second pixel in response to the degradation characteristic (e.g., the second degradation curve CURVE2 described with reference to FIG. 6) of the second pixel. According to the degradation characteristic (i.e., second degradation curve CURVE2) of the second pixel, the compensated grayscale values of the second pixel may be greater than the compensated grayscale values of the first pixel for the same accumulated usage time respectively.

The storage unit 820 may supply the lookup tables LUT1 and LUT2 to the compensator 830 in response to a request from the compensator 830. In an exemplary embodiment, the storage unit 820 may supply the accumulated data DATA_AC to the compensator 830 in response to the request from the compensator 830.

The compensator 830 may generate the compensated data DATA3 by compensating the image data DATA2 based on the accumulated data DATA_AC and the lookup tables LUT1 and LUT2.

In one exemplary embodiment, for example, the compensator 830 may calculate the first compensated grayscale value GRAY1' from the first grayscale value GRAY1 (i.e., the grayscale value corresponding to the first pixel) based on the first accumulated grayscale value GRAY_AC1 and the first lookup table LUT1. In such an embodiment, the compensator 830 calculate the second compensated grayscale value GRAY2' from the second grayscale value GRAY2 (i.e., the grayscale value corresponding to the second pixel) based on the second accumulated grayscale value GRAY_AC2 and the second lookup table LUT2.

In an exemplary embodiment, the compensator 830 may include a selector 831 and a calculator 832.

The selector 831 may generate a compensation data DATA_C corresponding to the image data DATA2 based on the accumulated data DATA_AC and the lookup tables LUT1 and LUT2.

In one exemplary embodiment, for example, the selector 831 may select the first lookup table LUT1 based on position information (i.e., coordinate in the image data DATA2, which is a coordinate of the corresponding pixel in the display unit 100) of the first grayscale value GRAY1, and may obtain a first grayscale compensation value from the first lookup table LUT1 based on the first accumulated usage time (or the first accumulated grayscale value GRAY_AC1) of the first grayscale value GRAY1. In such an embodiment, the selector 831 may select the second lookup table LUT2 based on position information of the second grayscale value GRAY2, and may obtain a second grayscale compensation value from the second lookup table LUT2 based on the second accumulated usage time (or the second accumulated grayscale value GRAY_AC2) of the second grayscale value GRAY2. That is, the selector 831 may determine whether the position information of the grayscale values corresponds to the predetermined sensing region SA and select one of the lookup tables LUT1 and LUT2 based on the determination result.

The selector 831 may generate compensation data DATA_C including the first grayscale compensation value and the second grayscale compensation value.

The calculator 832 may generate compensated data DATA3 by adding the compensation data DATA_C to the image data DATA2. In one exemplary embodiment, for example, the calculator 832 may calculate a first compensated grayscale value GRAY1' by adding the first grayscale compensation value to the first grayscale value GRAY1, and calculate a second compensated grayscale value GRAY2' by adding the second grayscale compensation value to the second grayscale value GRAY2.

As described with reference to FIG. 8, the degradation compensator 600 may compensate for the first grayscale value GRAY1 corresponding to the first pixel in the non-sensing region NSA by using the first lookup table LUT1, and may compensate for the second grayscale value GRAY2 corresponding to the second pixel in the sensing region SA by using the second lookup table LUT2.

In an exemplary embodiment, when the display panel DP (or display unit 100) of FIG. 3 includes pixels (e.g., the first to third pixels PX1, PX2 and PX3 described with reference to FIG. 4) emit different colors from each other, the degradation compensator 600 may compensate for the pixels by using different degradation curves (or degradation compensation equations, lookup tables).

Figure 9A:
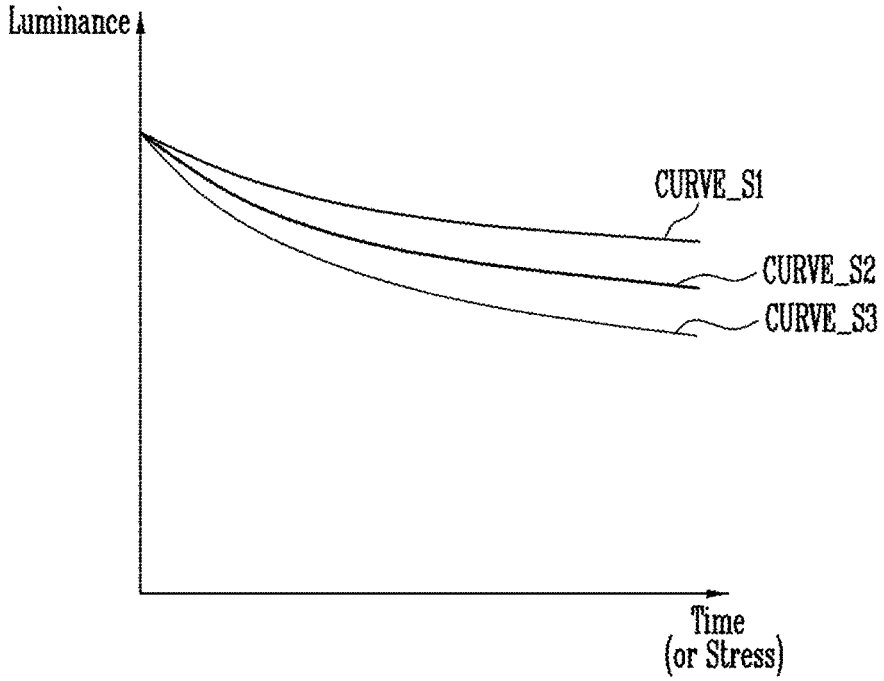
FIGS. 9A and 9B are graphs illustrating a degradation characteristic of each pixel of FIG. 4.
Figure 9B:
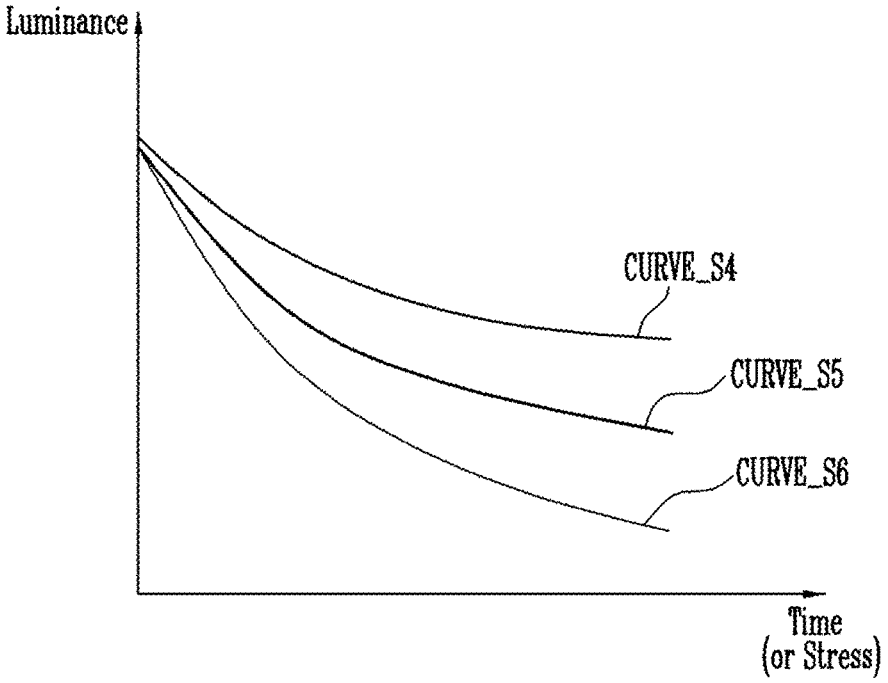

FIGS. 9A and 9B are graphs illustrating a degradation characteristic of each pixel of FIG. 4. FIG. 9A shows sub-degradation curves CURVE_S1, CURVE_S2, and CURVE_S3 for the pixels PX1, PX2, and PX3 in the non-sensing region NSA shown in FIG. 4, and FIG. 9B shows sub-degradation curves CURVE_S4, CURVE_S5, and CURVE_S6 for the pixels PX1, PX2, and PX3 in the sensing region SA. As described with reference to FIG. 4, the pixels PX1, PX2, and PX3 may emit different colors from each other.

Each of the sub-degradation curves CURVE_S1 to CURVE_S6 represents a luminance change (or luminance reduction rate) according to the accumulated usage time (or stress) of the pixels PX1, PX2, and PX3.

First, referring to FIGS. 8 and 9A, the first sub-degradation curve CURVE_S1 represents a degradation characteristic of the first pixel PX1 in the non-sensing region NSA, and the second sub-degradation curve CURVE_S2 represents a degradation characteristic of the second pixel PX2 in the non-sensing region NSA, and the third sub-degradation curve CURVE_S3 represents a degradation characteristic of the third pixel PX3 in the non-sensing region NSA.

According to the first to third sub-degradation curves CURVE_S1 to CURVE_S3, the second pixel PX2 may represent a larger degradation acceleration (i.e., has a relatively large degradation acceleration factor) than the first pixel PX1 based on the accumulated usage time, and the third pixel PX3 may represent a larger degradation acceleration than the second pixel PX2 based on the accumulated usage time.

Therefore, the storage unit 820, which is described with reference to FIG. 8, may store the lookup tables corresponding to the first to third sub-degradation curves CURVE_S1 to CURVE_S3 respectively, and the compensator 830 (or selector 831) may select one of the lookup tables based on color or arrangement position of the pixel corresponding to the grayscale value included in the image data DATA2 and compensate for the grayscale value based on the selected one lookup table.

Referring to FIGS. 8 and 9B, the fourth sub-degradation curve CURVE_S4 represents the degradation characteristic of the first pixel PX1 in the sensing region SA, the fifth sub-degradation curve CURVE_S5 represents the degradation characteristic of the second pixel PX2 in the sensing region SA, and the sixth sub-degradation curve CURVE_S6 represents the degradation characteristic of the third pixel PX3 in the sensing region SA.

According to the fourth to sixth sub-degradation curves CURVE_S4 to CURVE_S6, the second pixel PX2 may represent a larger degradation acceleration (i.e., has a relatively large degradation acceleration factor) than the first pixel PX1 based on the accumulated usage time, and the third pixel PX3 may represent a larger degradation acceleration than the second pixel PX2 based on the accumulated usage time. In addition, the fourth to sixth sub-degradation curves CURVE_S4 to CURVE_S6 may be different from the first to third sub-degradation curves CURVE_S1 to CURVE_S3 shown in FIG. 9A.

Therefore, the storage unit 820, which is described above with reference FIG. 8, may further store lookup tables corresponding to the fourth to sixth sub-degradation curves CURVE_S4 to CURVE_S6, and the compensator 830 (or selector 831) may select one of the lookup tables based on color or arrangement position of the pixel corresponding to the grayscale value included in the image data DATA2 and compensate for the grayscale value based on the selected one of the lookup tables.

Figure 10A:
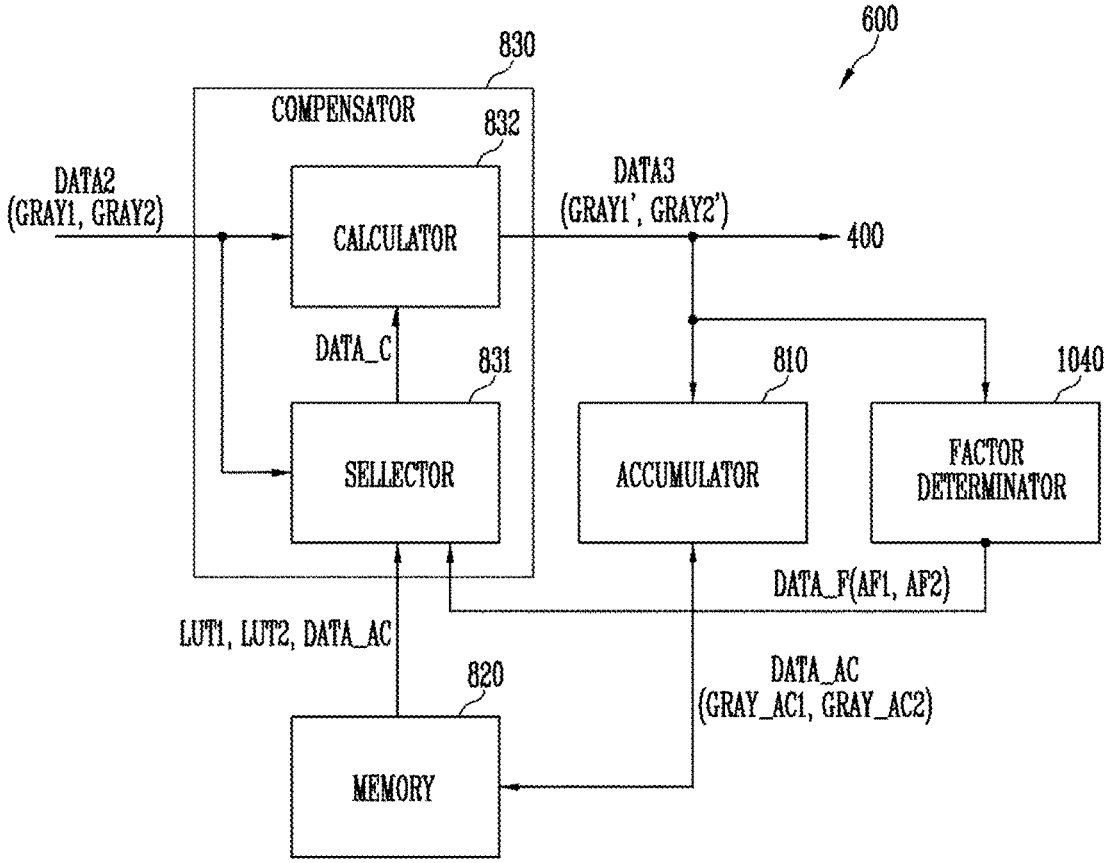
FIGS. 10A and 10B are block diagrams for illustrating an alternative exemplary embodiment of a degradation compensator included in a display panel of FIG. 3.
Figure 10B:
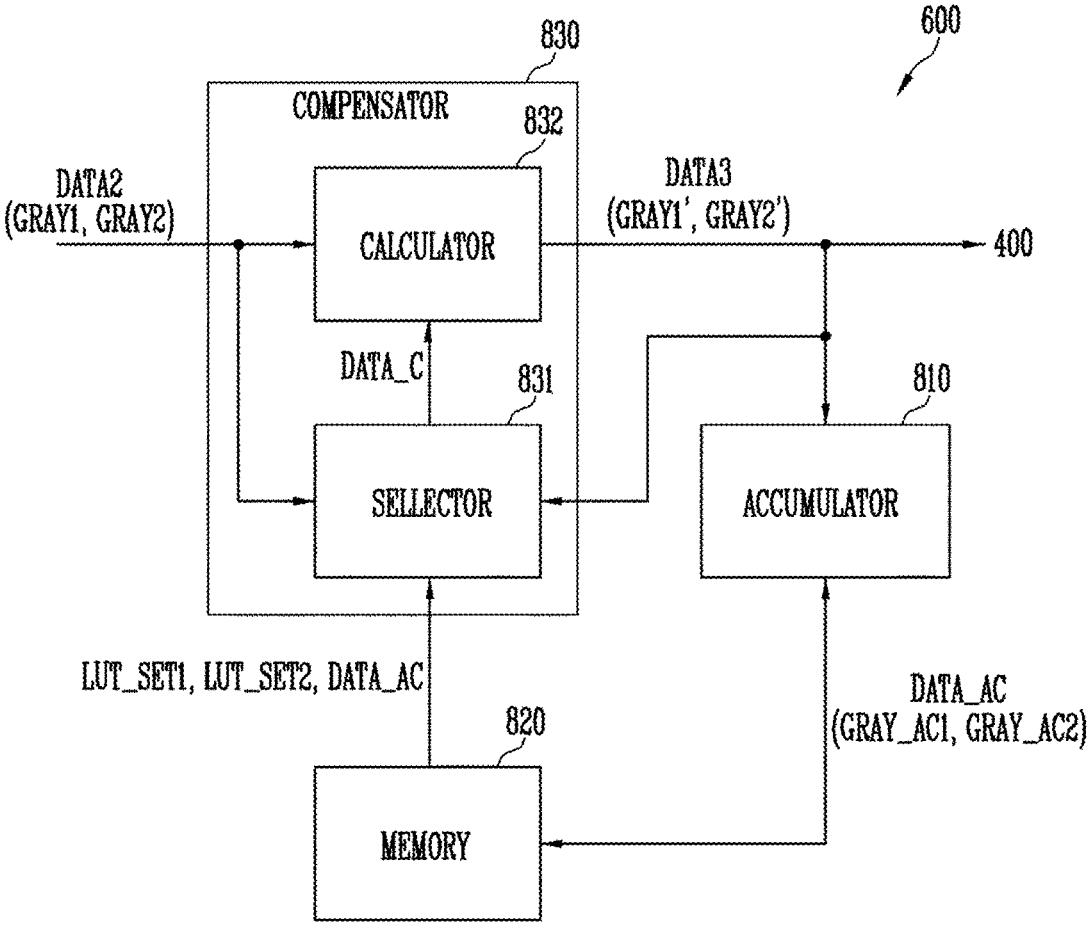
Figure 11:
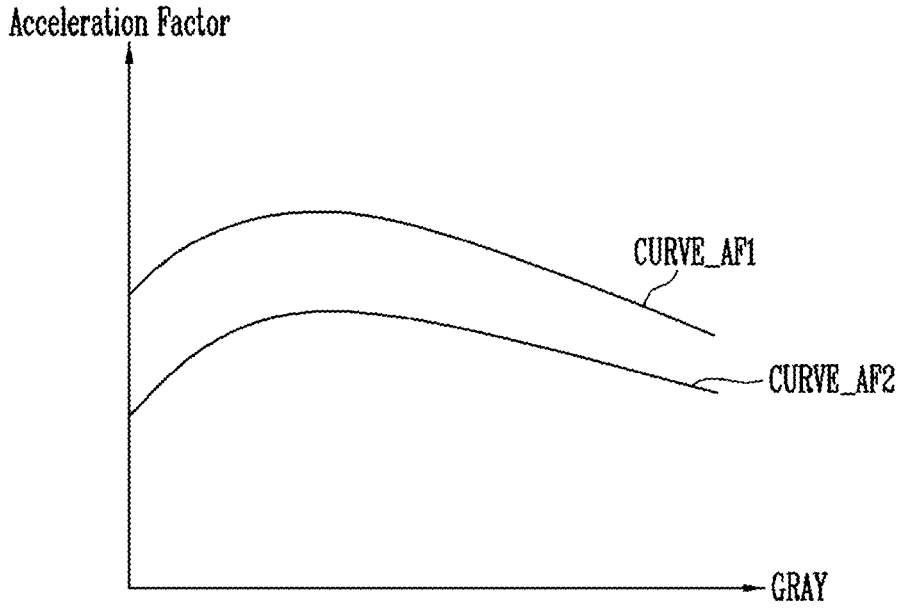
FIG. 11 is a graph illustrating an exemplary embodiment of a grayscale factor used in a degradation compensator of FIG. 10A.

FIGS. 10A and 10B are block diagrams for illustrating an alternative exemplary embodiment of a degradation compensator included in a display panel of FIG. 3. FIG. 11 is a graph illustrating an exemplary embodiment of a grayscale factor used in a degradation compensator of FIG. 10A.

First, referring to FIGS. 8 and 10A, the degradation compensator 600 shown in FIG. 10A is substantially the same as or similar to the degradation compensator 600 shown in the FIG. 8 except for a factor determinator 1040 (or first factor determinator). Thus, for convenience of description, any repetitive detailed description of the same or like elements will be omitted.

Each of the first lookup table LUT1 and the second lookup table LUT2 may include only compensated grayscale values or grayscale compensation values for the first representative grayscale value. In one exemplary embodiment, for example, the first representative grayscale value may be a grayscale value of 255 of a 255 grayscale values, and the first lookup table LUT1 may include only compensated grayscale values or grayscale compensation values for a grayscale value of 255. In such an embodiment, a size of the lookup table may be smaller than a size of the lookup table for entire grayscale values.

In such an embodiment, the compensated grayscale values or grayscale compensation values of the first representative grayscale value (e.g., a grayscale value of 255) may be different from the compensated grayscale values or grayscale compensation values of other grayscale values (e.g., a grayscale value of 100).

Therefore, the degradation compensator 600 of FIG. 10A may compensate for other compensated grayscale value by using a grayscale factor (or degradation acceleration factor for each grayscale) representing the degradation compensation ratio (or weight value) of other compensated grayscale value with reference to the first representative grayscale value.

In an exemplary embodiment, the storage unit 820 may further include a first factor lookup table. Here, the first factor lookup table may be set based on grayscale factor curves CURVE_AF1 and CURVE_AF2 shown in FIG. 11 and may include a grayscale factor set for each grayscale.

Referring to FIG. 11, a first grayscale factor curve CURVE_AF1 represents a degradation acceleration factor set for each grayscale at the first accumulated usage time (e.g., time when accumulated usage time is 0), and a second grayscale factor curve CURVE_AF2 represents a degradation acceleration factor set for each grayscale at the second accumulated usage time. Here, the second accumulated usage time may be greater than the first accumulated usage time.

According to the first and second grayscale factor curves CURVE_AF1 and CURVE_AF2, the first grayscale factor increases as the grayscale value increases in the low grayscale region having a low grayscale value, and the first grayscale factor decreases as the grayscale value increases in the high grayscale region having a high grayscale value. In addition, as the accumulated usage time increases, the first grayscale factor may decrease overall.

Referring back to FIG. 10A, the factor determinator 1040 may generate degradation acceleration data DATA_F based on the compensated data DATA3 and the first factor lookup table. The degradation acceleration data DATA_F may include the first grayscale factor AF1 for the first pixel (i.e., the pixel in the non-sensing region NSA) and the second grayscale factor AF2 for the second pixel (i.e., the pixel in the sensing region SA).

In one exemplary embodiment, for example, the factor determinator 1040 may calculate the first grayscale factor AF1 for the first compensated grayscale value GRAY1' based on the first factor lookup table (e.g., the first grayscale factor curve CURVE_AF1). In such an embodiment, the factor determinator 1040 may obtain the first accumulated usage time for the first pixel from the accumulator 810 (or storage unit 820) and may select one of a plurality of factor lookup tables (e.g., one of the lookup tables corresponding to the first and second grayscale factor curves CURVE_AF1 and CURVE_AF2) based on the first accumulated usage time to calculate the first grayscale factor AF1. In such an embodiment, the factor determinator 1040 may calculate the second grayscale factor AF2 for the second compensated grayscale value GRAY2' based on the first factor lookup table.

According to an exemplary embodiment, the compensator 830 may generate compensated data DATA3 by compensating image data DATA2 based on the first and second lookup tables LUT1 and LUT2, accumulated data DATA_AC and degradation acceleration data DATA_F.

In one exemplary embodiment, for example, the selector 831 may compensate for the first grayscale compensation value GRAY1_D1 by multiplying the first grayscale factor AF1 with the first grayscale compensation value GRAY1_D1 (see Table 1) obtained based on the first lookup table LUT1 and the first accumulated grayscale value GRAY_AC1. In such an embodiment, the selector 831 may compensate for the second grayscale compensation value by multiplying the second grayscale factor AF2 with the second grayscale compensation value obtained based on the second lookup table LUT2 and the second accumulated grayscale value GRAY_AC2.

As described above with reference to FIGS. 10A and 11, the degradation compensator 600 may perform the degradation compensation for the first and second pixels by using the first and second lookup tables LUT1 and LUT2 and the first factor lookup table (or the grayscale factor curves CURVE_AF1 and CURVE_AF2) for the representative grayscale values. Thus, a storage capacity (or cost) of the degradation compensator 600 may be reduced.

In an exemplary embodiment, the factor determinator 1040 may be independent of the compensator 830 as shown in FIG. 10A, but not being limited thereto. In one alternative exemplary embodiment, for example, the factor determinator 1040 may be included in the compensator 830 or the selector 831.

Referring to FIGS. 8 and 10B, the degradation compensator 600 shown in FIG. 10B is substantially the same as or similar to the degradation compensator 600 shown in the FIG. 8 except that the degradation compensator 600 shown in FIG. 10B receives the compensated data DATA3 from the selector 831 (or compensator 830). Thus, for convenience of description, any repetitive detailed description of the same or like elements will be omitted.

Each of a first lookup table set LUT_SET1 and a second lookup table set LUT_SET2 may include sub-lookup tables (or lookup tables) including compensated grayscale values or grayscale compensation values for each of the representative grayscale values. Each of the sub-lookup tables may be substantially the same as or similar to the first lookup table LUT1 or the second lookup table LUT2 described above with reference to FIG. 8.

In one exemplary embodiment, for example, the representative grayscale values may include a grayscale value of 1, a grayscale value of 81, and a grayscale value of 255 of total 255 grayscale values, the first sub-lookup table included in the first lookup table set LUT_SET1 may include only compensated grayscale values or grayscale compensation values for the first representative grayscale value (e.g., the grayscale value of 255), and the second sub-lookup table may include only compensated grayscale values or grayscale compensation values for the grayscale value of 81. In an alternative exemplary embodiment, each of the first lookup table set LUT_SET1 and the second lookup table set LUT_SET2 may include compensated grayscale values or grayscale compensation values for each representative grayscale value as one lookup table.

According to an exemplary embodiment, the compensator 830 may generate compensation data DATA_C for image data DATA2 based on the first and second lookup table sets LUT_SET1 and LUT_SET2, the accumulated data DATA_AC, and the compensated data DATA3.

In one exemplary embodiment, for example, the selector 831 may select the first and second sub-lookup tables for the two representative grayscale values adjacent to the first compensated grayscale value GRAY1' from the first lookup table set LUT_SET1, obtain the grayscale compensation value from each of the first and second sub-lookup tables based on the first accumulated grayscale value GRAY_AC1 (i.e., accumulated usage time of the first pixel), and calculate the first grayscale compensation value for the first grayscale value GRAY1 by interpolating the grayscale compensation value of the first sub-lookup table and the grayscale compensation value of the second sub-lookup table based on the first accumulated grayscale value GRAY_AC1.

In such an embodiment, the selector 831 may select the third and fourth sub-lookup tables for the two representative grayscale values adjacent to the second compensated grayscale value GRAY2' from the second lookup table set LUT_SET2, obtain the grayscale compensation value from each of the third and fourth sub-lookup tables based on the second accumulated grayscale value GRAY_AC2, and calculate the second grayscale compensation value for the second grayscale value GRAY2 by interpolating the grayscale compensation value of the third sub-lookup table and the grayscale compensation value of the fourth sub-lookup table based on the second accumulated grayscale value GRAY_AC2.

In an exemplary embodiment, as described with reference to FIG. 10B, the degradation compensator 600 may perform the degradation compensation for the first and second pixels by using the first and second lookup table sets LUT_SET1 and LUT_SET2 and interpolation techniques for representative grayscale values that are a portion of the entire grayscale values. Thus, a storage capacity (or cost) of the degradation compensator 600 may be reduced.

Figure 12A:
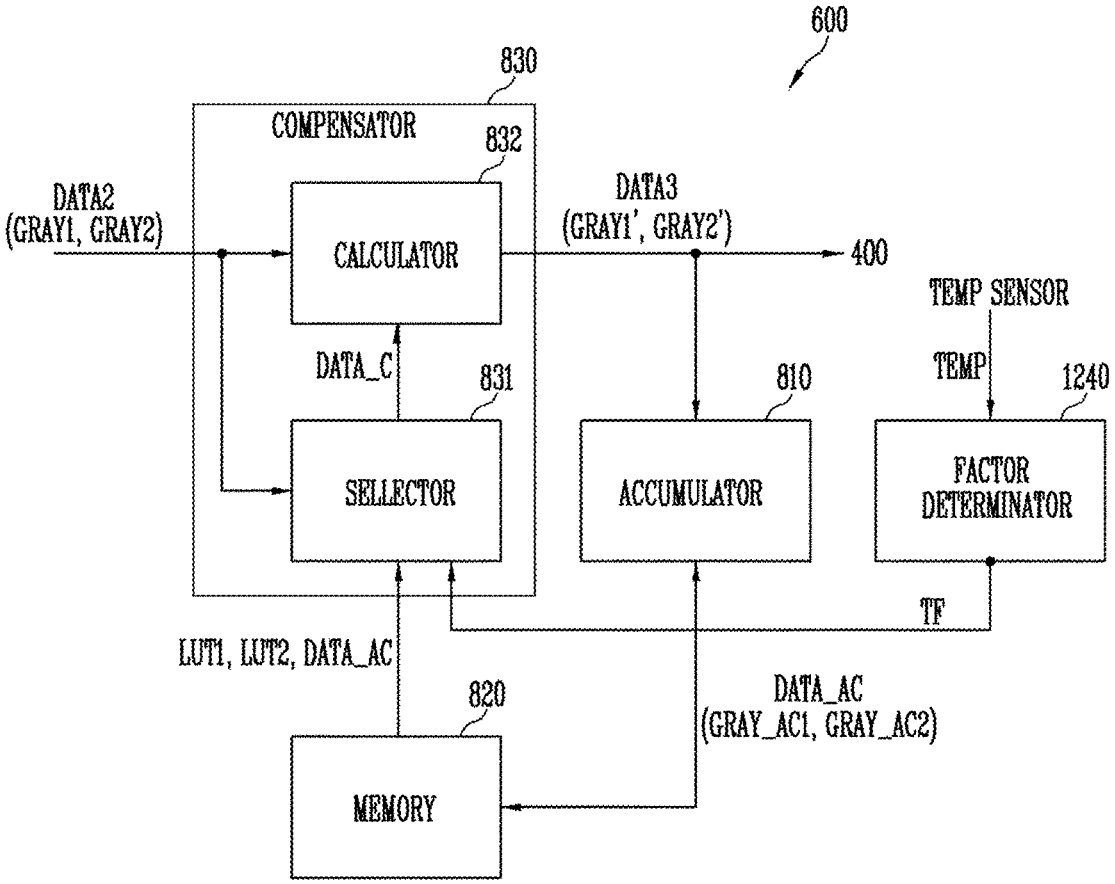
FIGS. 12A and 12B are is a block diagram for illustrating another alternative exemplary embodiment of a degradation compensator included in a display panel of FIG. 3.
Figure 12B:
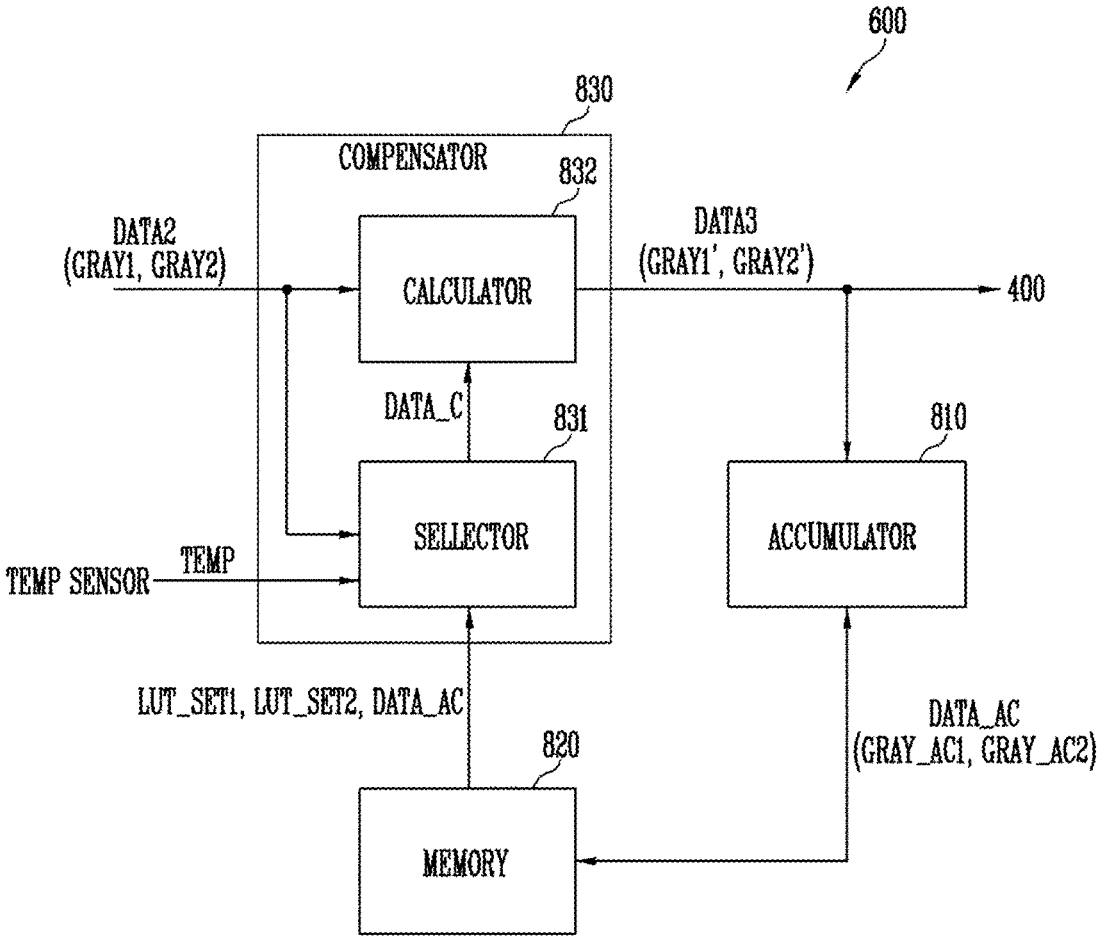
Figure 13:
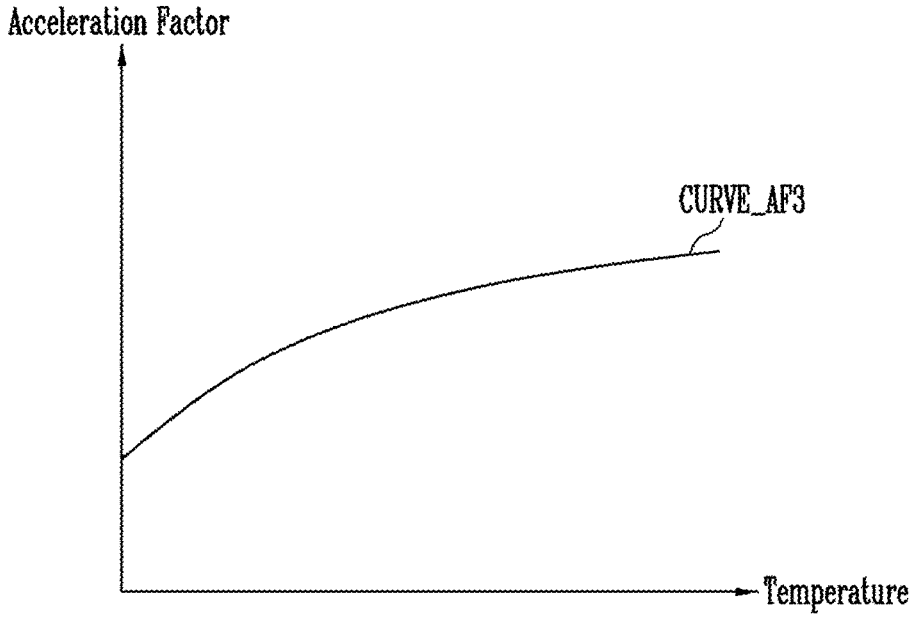
FIG. 13 is a graph illustrating an exemplary embodiment of a temperature factor used in a degradation compensator of FIG. 12A.

FIGS. 12A and 12B are is a block diagram for illustrating another alternative exemplary embodiment of a degradation compensator included in a display panel of FIG. 3. FIG. 13 is a graph illustrating an exemplary embodiment of a temperature factor used in a degradation compensator of FIG. 12A.

First, referring to FIGS. 8 and 12A, the degradation compensator 600 shown in FIG. 12A is substantially the same as or similar to the degradation compensator 600 shown in the FIG. 8 except for a factor determinator 1240 (or second factor determinator). Thus, for convenience of description, duplicate descriptions will be omitted.

The degradation compensator 600 of FIG. 12A may receive temperature information TEMP from a temperature sensor TEMP SENSOR and perform degradation compensation for the first and second pixels based on the temperature information TEMP. In an exemplary embodiment, the temperature sensor TEMP SENSOR may be provided in the display device DD (or display panel DP) and generate the temperature information TEMP by measuring a temperature inside the display panel DP or the display device DD.

The factor determinator 1240 may calculate the temperature factor TF based on the temperature information TEMP. In one exemplary embodiment, for example, the factor determinator 1240 may obtain the temperature factor TF corresponding to the temperature information TEMP by using the second factor lookup table. The second factor lookup table may include the temperature factor TF representing the additional degradation ratio (or additional luminance reduction ratio) corresponding to a temperature and be stored in the storage unit 820. Herein, a "lookup table set by temperature" means a lookup table includes values corresponding to predetermined temperatures as the second factor lookup table.

Referring to FIG. 13, the third temperature factor curve CURVE_AF3 (or third degradation acceleration factor curve) represents a degradation acceleration factor according to temperature. According to the third temperature factor curve CURVE_AF, the temperature factor TF may increase as the temperature increases.

Referring back to FIG. 12A, the compensator 830 may generate compensated data DATA3 by compensating image data DATA2 based on the first and second lookup tables LUT1 and LUT2, the accumulated data DATA_AC, and the temperature factor TF.

In one exemplary embodiment, for example, the selector 831 may compensate for the first grayscale compensation value GRAY1_D1 by multiplying the temperature factor TF with the first grayscale compensation value GRAY1_D1 (see Table 1) obtained based on the first lookup table LUT1 and the first accumulated grayscale value GRAY_AC1. In such an embodiment, the selector 831 may compensate for the second grayscale compensation value by multiplying the temperature factor TF with the second grayscale compensation value obtained based on the second lookup table LUT2 and the second accumulated grayscale value GRAY_AC2.

In an exemplary embodiment, the factor determinator 1240 may be independent of the compensator 830 as shown in FIG. 12A, but not being limited thereto. In one alternative exemplary embodiment, for example, the factor determinator 1240 may be included in a compensator 830 or the selector 831.

Referring to FIGS. 8 and 12B, the degradation compensator 600 shown in FIG. 12B is substantially the same as or similar to the degradation compensator 600 shown in the FIG. 8 except that the degradation compensator 600 shown in FIG. 12B receives the temperature information TEMP from the selector 831 (or compensator 830). Thus, for convenience of description, any repetitive detailed description of the same or like elements will be omitted.

Each of the first lookup table set LUT_SET1 and the second lookup table set LUT_SET2 may include sub-lookup tables (or lookup tables). Each of the sub-lookup tables may be substantially the same as or similar to the first lookup table LUT1 or the second lookup table LUT2 described above with reference to FIG. 8.

In one exemplary embodiment, for example, the first sub-lookup table included in the first lookup table set LUT_SET1 may include compensated grayscale values or grayscale compensation values according to the accumulated usage time at a first temperature, and the second sub-lookup table may include compensated grayscale values or grayscale compensation values according to the accumulated usage time at a second temperature.

According to an exemplary embodiment, the compensator 830 may generate compensation data DATA_C for image data DATA2 based on the first and second lookup table sets LUT_SET1 and LUT_SET2, the accumulated data DATA_AC, and the temperature information TEMP.

In one exemplary embodiment, for example, the selector 831 may select the first sub-lookup table corresponding to the temperature information TEMP from the first lookup table set LUT_SET1 and obtain the first grayscale compensation value corresponding to the first compensated grayscale value GRAY1' from the first sub-lookup table. In such an embodiment, the selector 831 may select the second sub-lookup table corresponding to the temperature information TEMP from the second lookup table set LUT_SET2 and obtain the second grayscale compensation value corresponding to the second compensated grayscale value GRAY2' from the second sub-lookup table.

In an exemplary embodiment, as described above with reference to FIGS. 12A and 12B, the degradation compensator 600 may perform the degradation compensation for the first and second pixels based on the temperature information TEMP of the display panel DP (or display device DD). Thus, the degradation of the first and second pixels may be accurately compensated.

According to exemplary embodiments of the invention as described herein, a degradation compensation device and a display device the degradation compensation device may compensate for a degradation of a pixel more accurately by performing degradation compensation for pixels disposed in regions having relatively different resolutions by using independent degradation curves of which degradation acceleration factors are different from each other.

The invention should not be construed as being limited to the exemplary embodiments set forth herein. Rather, these exemplary embodiments are provided so that this disclosure will be thorough and complete and will fully convey the concept of the invention to those skilled in the art.

While the invention has been particularly shown and described with reference to exemplary embodiments thereof, it will be understood by those of ordinary skill in the art that various changes in form and details may be made therein without departing from the spirit or scope of the invention as defined by the following claims.

What is claimed is:

1. A display device comprising:

a display unit including pixels, the pixels being identical to each other and including a first pixel disposed in a first region and a second pixel disposed in a second region different from the first region;

a degradation compensator which generates a first compensated grayscale value by compensating a first grayscale value for the first pixel based on a first degradation curve and generates a second compensated grayscale value by compensating a second grayscale value for the second pixel based on a second degradation curve, wherein the first degradation curve defines a luminance reduction rate according to a first accumulated usage time of the first pixel, and the second degradation curve defines a luminance reduction rate according to a second accumulated usage time of the second pixel differently from the first degradation curve such that the luminance reduction rate of the second degradation curve and the luminance reduction rate of the first degradation curve are different from each other when the first accumulated usage time of the first pixel and the second accumulated usage time of the second pixel identical to the first pixel are equal to each other; and a data driver which generates a first data signal based on the first compensated grayscale value, supplies the first data signal to the first pixel, generates a second data signal based on the second compensated grayscale value, and supplies the second data signal to the second pixel, wherein a light transmittance of the second region is greater than a light transmittance of the first region.

2. The display device of claim 1, wherein the display unit includes a transmissive region between the second pixel and an adjacent pixel in the second region, the transmissive region transmits at least a portion of incident light, the adjacent pixel is disposed adjacent to the second pixel in the second region, and a resolution of the second region is lower than a resolution of the first region.

3. The display device of claim 2, further comprising:

an optical sensor disposed to overlap the second region of the display unit, wherein the optical sensor senses light transmitted to the second region.

4. The display device of claim 2, wherein a voltage level of the first data signal is different from a voltage level of the second data signal when the first grayscale value and the second grayscale value are equal to each other, and a difference between a voltage level of the first data signal and a voltage level of the second data signal increases as the first accumulated usage time or the second accumulated usage time increases when the first accumulated usage time and the second accumulated usage time are equal to each other.

5. The display device of claim 4, wherein each of the first pixel and the second pixel includes a transistor and a light emitting element connected to the transistor to receive a driving current through the transistor, and a second driving current flowing in the second pixel corresponding to the second data signal is greater than a first driving current flowing in the first pixel corresponding to the first data signal when the first grayscale value and the second grayscale value are equal to each other.

6. The display device of claim 1, wherein the degradation compensator compensates for the first grayscale value using a first lookup table and compensates for the second grayscale value using a second lookup table, the first lookup table includes a first grayscale compensation value corresponding to the first accumulated usage time based on the first degradation curve, and the second lookup table includes a second grayscale compensation value corresponding to the second accumulated usage time based on the second degradation curve.

7. The display device of claim 6, wherein a second degradation acceleration factor, which refers to a slope of a tangent with respect to the second degradation curve, is greater than a first degradation acceleration factor, which refers to a slope of a tangent with respect to the first degradation curve, under a condition that an initial luminance of the first pixel and an initial luminance of the second pixel are the same and the first accumulated usage time and the second accumulated usage time are the same.

8. The display device of claim 6, wherein the degradation compensator includes:

an accumulator which calculates the first accumulated usage time by accumulating the first compensated grayscale value and calculates the second accumulated usage time by accumulating the second compensated grayscale value;

a memory device which stores the first and second accumulated usage time and the first and second lookup tables; and a compensator which obtains the first grayscale compensation value based on the first accumulated usage time and the first lookup table, compensates the first grayscale value based on the first grayscale compensation value, obtains the second grayscale compensation value based on the second accumulated usage time and the second lookup table, and compensates the second grayscale value based on the second grayscale compensation value.

9. The display device of claim 8, wherein the first grayscale value and the second grayscale value are included in an image data, and the compensator includes:

a selector which selects the first lookup table based on position information of the first grayscale value in the image data and selects the second lookup table based on position information of the second grayscale value in the image data; and a calculator which calculates the first compensated grayscale value by adding the first grayscale compensation value obtained from the first lookup table to the first grayscale value and calculates the second compensated grayscale value by adding the second grayscale compensation value obtained from the second lookup table to the second grayscale value.

10. The display device of claim 8, wherein the second pixel includes sub-pixels which emit light of different colors from each other, and the second lookup table includes sub-lookup tables corresponding to degradation curves of the sub-pixels, respectively.

11. The display device of claim 6, wherein the second lookup table is set for a representative grayscale value, the representative grayscale value is a grayscale value within a grayscale range of the second grayscale value, the degradation compensator compensates for the second grayscale value based on a grayscale factor, and the grayscale factor is a degradation compensation ratio set based on the representative grayscale value.

12. The display device of claim 11, wherein the degradation compensator further includes a first factor lookup table including the grayscale factor set for each grayscale value.

13. The display device of claim 6, wherein the second lookup table includes sub-lookup tables for representative grayscale values, and the degradation compensator selects first and second sub-lookup tables from the sub-lookup tables corresponding to first and second representative grayscale values adjacent to the second grayscale value of the representative grayscale values from the sub-lookup tables, obtains a grayscale compensation value from each of the first and second sub-lookup tables based on the second accumulated usage time, and calculates the second grayscale compensation value by interpolating a grayscale compensation value obtained from the first sub-lookup table and a grayscale compensation value obtained from the second sub-lookup table.

14. The display device of claim 6, wherein the degradation compensator determines a temperature factor based on temperature information received from an outside and compensates for the second grayscale value based on the temperature factor.

15. The display device of claim 14, wherein the degradation compensator further includes a second factor lookup table including the temperature factor set by temperature.

16. The display device of claim 6, wherein the second lookup table includes sub-lookup tables set by temperature, and the degradation compensator selects one of the sub-lookup tables based on temperature information received from an outside and obtains the second gray-scale compensation value from the selected one of the sub-lookup tables based on the second accumulated usage time.

17. The display device of claim 1, wherein the first pixel and the second pixel emit light with a same color, and an emitting area of the first pixel and an emitting area of the second pixel are not different.

* * * * *